US009913527B1

(12) United States Patent
Merton, Sr.

(10) Patent No.: US 9,913,527 B1
(45) Date of Patent: Mar. 13, 2018

(54) POLICE AND SECURITY PORTABLE RADIO MICROPHONE AND BODY WORN CAMERA HOLDER

(71) Applicant: David M. Merton, Sr., Bedford, TX (US)

(72) Inventor: David M. Merton, Sr., Bedford, TX (US)

( * ) Notice: Subject to any disclaimer, the term of this patent is extended or adjusted under 35 U.S.C. 154(b) by 0 days.

(21) Appl. No.: 15/432,716

(22) Filed: Feb. 14, 2017

Related U.S. Application Data

(63) Continuation-in-part of application No. 14/697,485, filed on Apr. 27, 2015, which is a continuation-in-part of application No. 14/267,907, filed on May 1, 2014, now abandoned.

(60) Provisional application No. 61/818,105, filed on May 1, 2013.

(51) Int. Cl.
*A45F 5/02* (2006.01)
*H04R 1/08* (2006.01)

(52) U.S. Cl.
CPC *A45F 5/02* (2013.01); *H04R 1/08* (2013.01)

(58) Field of Classification Search
CPC ..... A45F 5/02; H04R 1/08
See application file for complete search history.

(56) References Cited

U.S. PATENT DOCUMENTS

| | | | | | |
|---|---|---|---|---|---|
| 1,392,715 | A * | 10/1921 | Sommer | A45F 5/02 | 24/3.12 |
| 3,112,028 | A * | 11/1963 | Kinsell | A45F 5/02 | 206/265 |
| 5,499,429 | A * | 3/1996 | Higginbotham | A44B 99/00 | 224/269 |
| 5,533,656 | A * | 7/1996 | Bonaldi | A45C 1/04 | 224/269 |
| 2008/0305840 | A1* | 12/2008 | Lin | A45F 5/02 | 455/575.1 |

* cited by examiner

*Primary Examiner* — Robert Sandy
*Assistant Examiner* — David M Upchurch
(74) *Attorney, Agent, or Firm* — Mark H. Plager

(57) ABSTRACT

A portable radio microphone and body worn camera holder is configured to join a police and security radio microphone and a police worn body camera to a uniform via the ballistic vest's trauma plate pocket. The microphone holder has a back panel connected to rounded top portion. The rounded top portion further has a first microphone attachment section. A first incline portion is smoothly connected to the rounded top portion. A first front panel is smoothly connected to the first incline portion. The first front panel further comprises a camera attachment section. A second incline portion is smoothly connected to the first front panel. The first front panel and the second incline portion further have a police worn body camera attachment portion. A second front panel is smoothly connected to the second incline portion.

11 Claims, 8 Drawing Sheets

POLICE AND SECURITY PORTABLE RADIO MICROPHONE AND BODY WORN CAMERA HOLDER

RELATED APPLICATION

This application is a continuation-in-part of U.S. Non-provisional patent application Ser. No. 14/697,485 filed on Apr. 27, 2015. That application is a continuation-in-part of U.S. Non-provisional patent application Ser. No. 14/267,907 filed on May 1, 2014. That application in turn claims priority to provisional patent application U.S. Ser. 61/818,105 filed on May 1, 2013. The entire contents of all of these applications are herein incorporated by reference.

BACKGROUND

The embodiments herein relate generally to clothing accessories.

Prior to the disclosed invention, portable microphones were mounted to a police officer's epaulet or front of shirt. As a result, in a fight, foot pursuit or strenuous activity, the microphone would become detached and was useless. Some officers could not be heard well because they kept the microphone on one's shoulder. Further, officers had to turn their head to talk toward the microphone, which took one's eyes off of one's focal point, which could be dangerous. If an officer could not use one's hands, for instance when using both hands with a suspect or if injured, the officer could not activate the microphone with one's chin. Additionally, the shoulder mounted microphone came with a cord of sufficient length to choke the officer if the cord was engaged by a suspect. The present invention solves these problems.

SUMMARY

A portable police and security radio microphone holder is configured to join a microphone and a body worn camera to a shirt via attachment to a ballistic vest. The microphone holder has a back panel connected to rounded top portion. The rounded top portion further has a first microphone attachment section. A first incline portion is smoothly connected to the rounded top portion. A first front panel is smoothly connected to the first incline portion. The first front panel further comprises a body worn camera attachment section. A second incline portion is smoothly connected to the first front panel. The first front panel and the second incline portion further have a body worn camera attachment portion. A second front panel is smoothly connected to the second incline portion.

In some embodiments, a high friction surface can be connected to the back panel. In other embodiments, a high friction surface can be connected to the front panel. In some embodiments, a back panel central axis can be parallel to the back panel. A rounded top portion central axis can be parallel to the rounded top portion. A first angle can be measured from the back panel central axis to the rounded top portion central axis. The first angle can be acute. The first angle can be about 65 degrees.

In some embodiments, a first incline portion central axis can be parallel to the first incline portion. A second angle can be measured from the rounded top portion central axis to the first incline portion central axis. A first front panel central axis can be parallel to the first front panel. A third angle can be measured from the first incline portion central axis to the first front panel central axis. The second angle and the third angle can be approximately equal. The second angle and the third angle can be obtuse. The second angle and the third angle can be about 130 degrees. A sum of the first angle, the second angle and the third angle can be less than 360 degrees.

In some embodiments, a second incline portion central axis can be parallel to the second incline portion. A fourth angle, can be measured from the first front panel central axis to the second incline portion central axis. A first end of the first front panel, which can be proximate the fourth angle, can be more proximate the back panel than a second end of the first front panel, which can be proximate the third angle.

A second front panel central axis can be parallel to the second front panel. A fifth angle can be measured from the second incline portion central axis to the second front panel central axis. The fourth angle and the fifth angle can be approximately equal. The first front panel central axis can be parallel to the second front panel central axis.

BRIEF DESCRIPTION OF THE FIGURES

The detailed description of some embodiments of the invention is made below with reference to the accompanying figures, wherein like numerals represent corresponding parts of the figures.

DETAILED DESCRIPTION OF CERTAIN EMBODIMENTS

Figure 1:
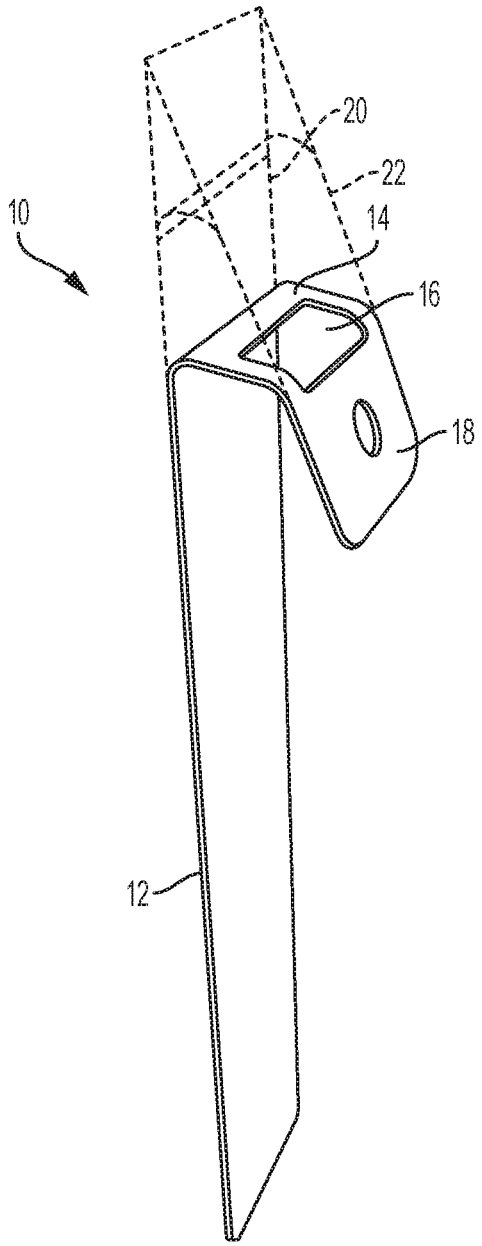
FIG. 1 shows a perspective view of one embodiment of the present invention.
Figure 2:
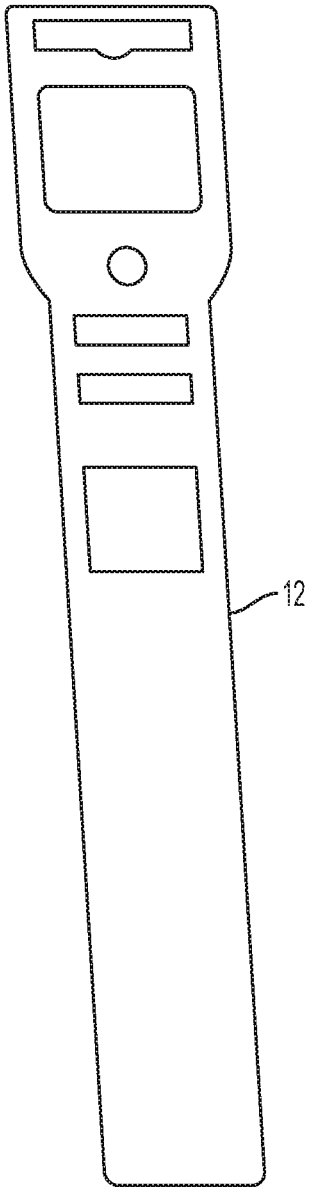
FIG. 2 shows a perspective view of one embodiment of the present invention.
Figure 3:
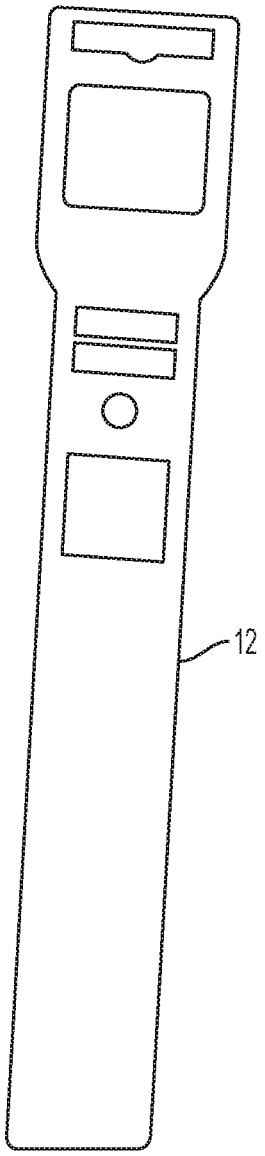
FIG. 3 shows a perspective view of one embodiment of the present invention.

By way of example, and referring to FIG. 1, FIG. 2, FIG. 3 and FIG. 4, one embodiment of microphone holder 10 comprises back panel 12 which is molded into top panel 14. Top panel 14 further comprises top window 16. Top panel 14 further bends into front panel 18.

Back panel 12 lies in back panel plane 20. Front panel 18 lies in front panel plane 22. Back panel plane 20 intersects front panel plane 22 at an angle that when measured from back panel plane 20 toward front panel plane 22 is in a range of 15 to 45 degrees. Preferably, the angle is about 30 degrees.

Figure 4:
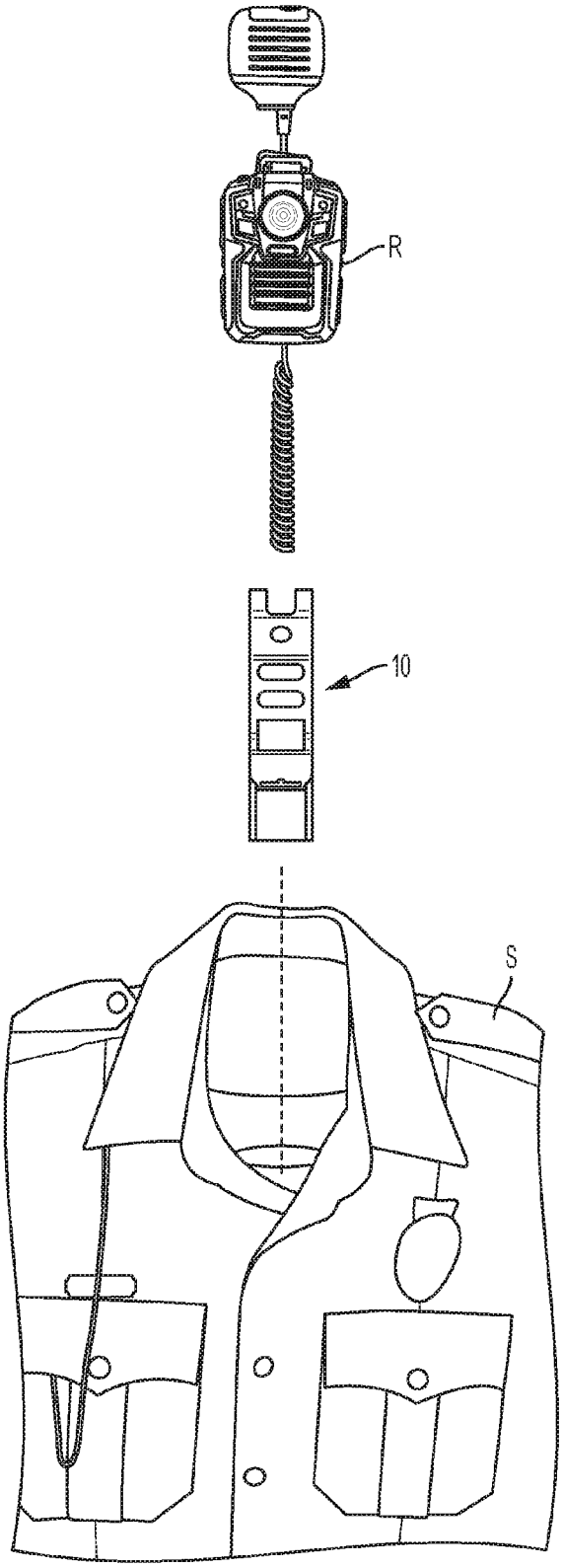
FIG. 4 shows a perspective view of one embodiment of the present invention as it would attach to the carrier under the officer's shirt.
Figure 5:
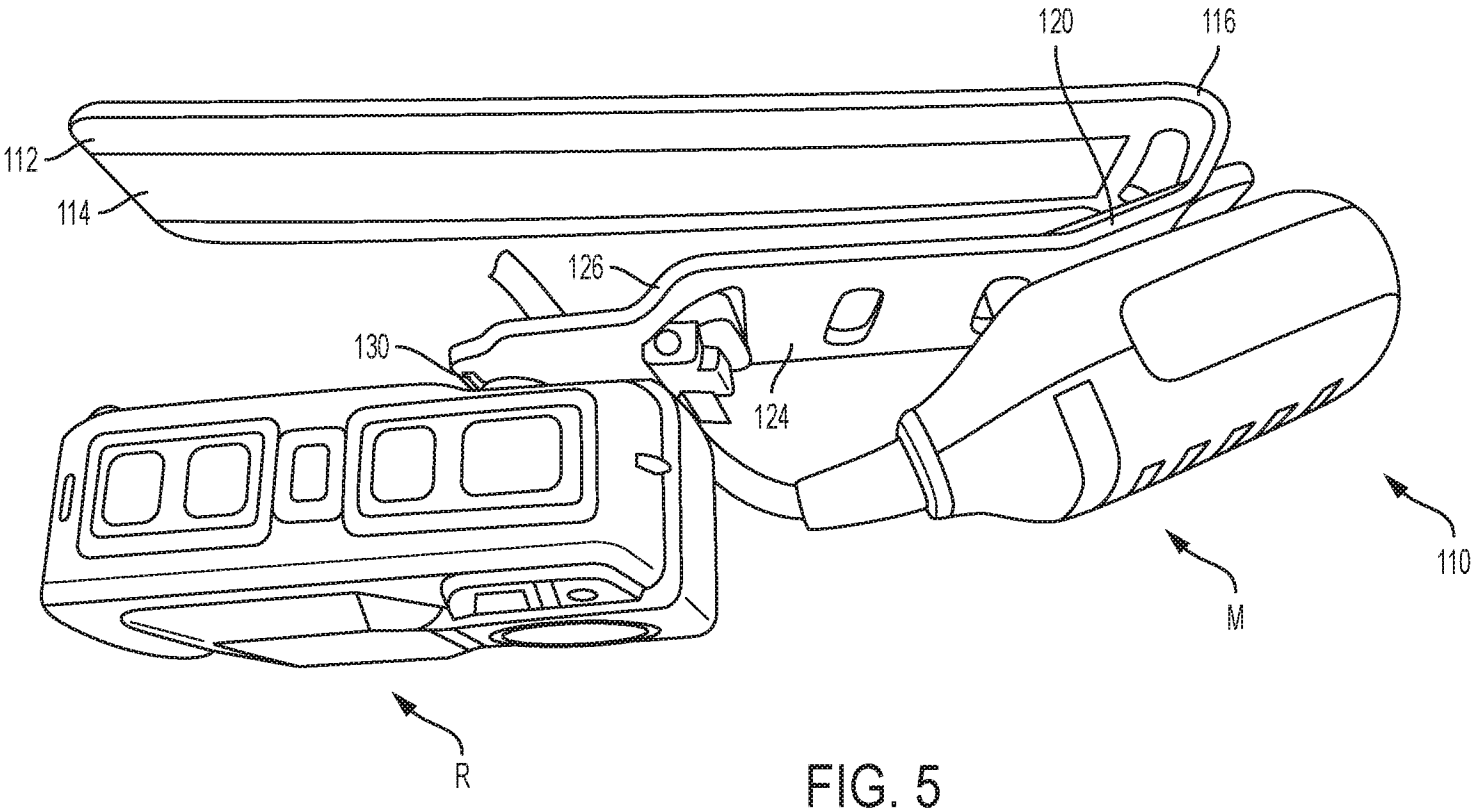
FIG. 5 shows a perspective view of one embodiment of the present invention in use.
Figure 6:
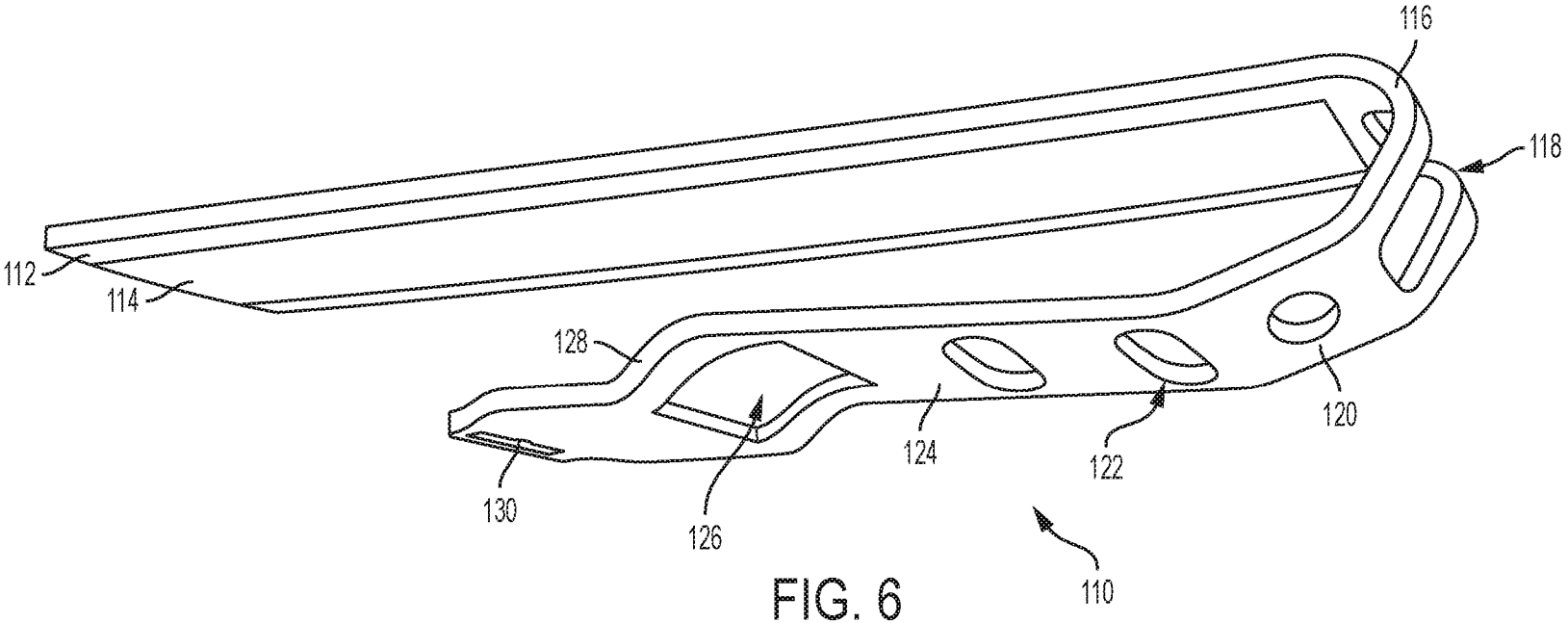
FIG. 6 shows a side perspective view of one embodiment of the present invention.
Figure 7:
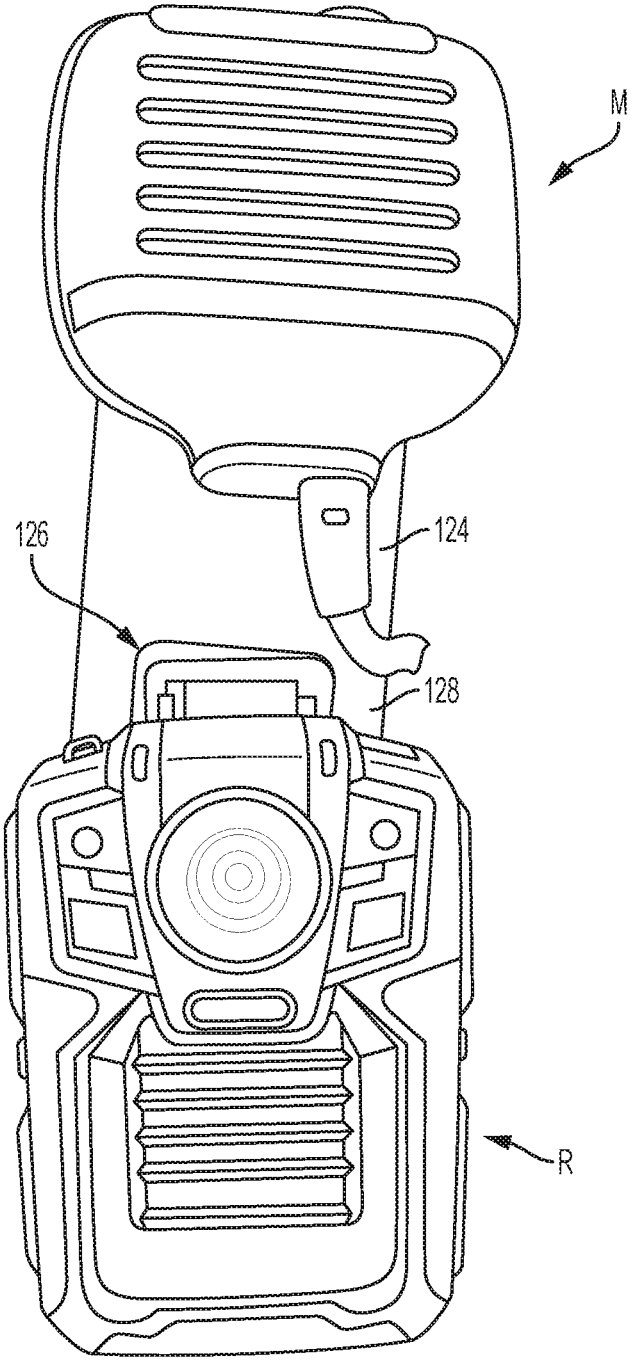
FIG. 7 shows a front view of one embodiment of the present invention in use.

There are two general contexts where microphone holder 10 would be used in conjunction with shirt S and police body worn camera R as shown in FIG. 4. In the first instance the user is wearing a concealable vest underneath shirt S. In this case a hook and loop fastener can be attached to back panel 12 in order to connect microphone holder 10 inside a trauma plate pocket within the concealable vest underneath shirt S. In an alternate configuration, the human user is wearing an outer carrier, and since the outer carrier does not have a hook and loop fastener, a loop fastener needs to be sewn to the outer carrier, then a hook fastener can be taped onto a front panel to connect back panel 12 to the outer carrier.

An armor plate carriers with Modular Lightweight Load-carrying Equipment (MOLLE) attachments can have microphone holder 10 attached by attaching the loop fastener to the front of back panel 12. Then, weaving microphone holder 10 to through the MOLLE webbing and securing microphone holder 10 by attaching the hook fastener to the exposed loop fastener attached to holder 10

Because of these relatively narrow uses, there is a limited variety of dimensions that can be effective. Microphone holder 10 can be made from a piece of metal, plastic including the thermoplastic acrylic-polyvinyl chloride materials manufactured under trade name KYDEX® or acrylic-polyvinyl chloride manufactured under the trademark IPK® that is seven inches by one inch and is rectangular, top window can 16 be arranged to be 1 inch by ½ inch. These dimensions are critical to accommodate a clip on the back of the microphone so that the microphone is positively secured to microphone holder 10. Further, the microphone can now be activated with the human user's chin, providing a hands free mode to a push to talk technology. Once the piece of metal has been punched, the piece of metal can be bent with a metal break. After that, the metal piece can be smoothed, coated with paint and dried.

Turning to FIGS. 5-10, microphone holder 110 comprises back panel 112. Back panel 112 is attached to a high friction surface 114. A high friction surface is one that has a coefficient of static friction that is more than twice that of the material of which back panel 112 is made. Back panel 112 is connected to rounded top portion 116. Rounded top portion 116 further comprises first microphone attachment section 118. Rounded top portion 116 is smoothly connected to first incline portion 120. First incline portion 120 is smoothly connected to first front panel 124. First front panel 124 further comprises camera attachment section 122. First front panel 124 is smoothly connected to second incline portion 128. First front panel 124 and second incline portion 128 further comprise radio attachment portion 126. Second incline portion 128 is smoothly connected to second front panel 130.

Figure 8:
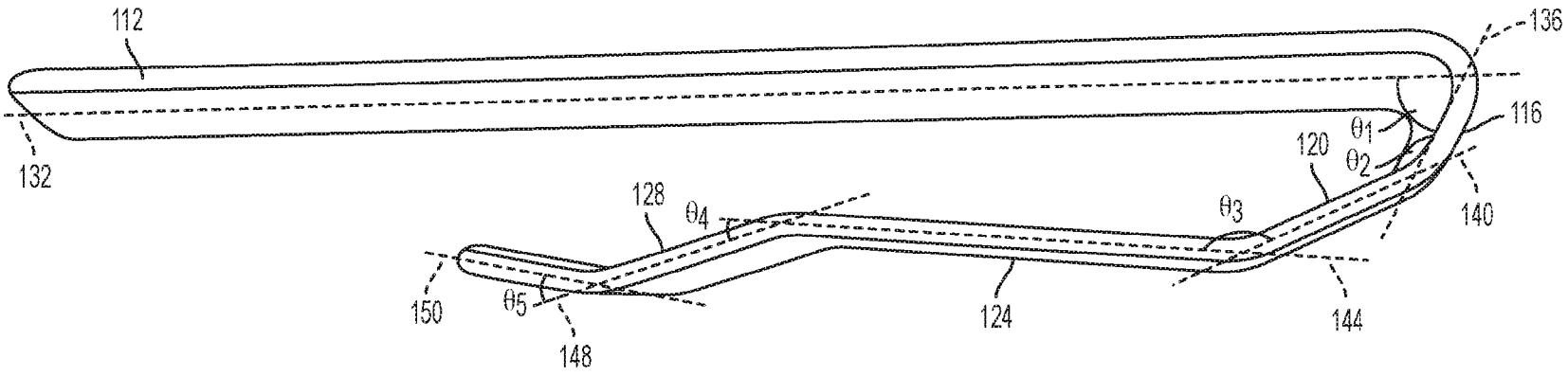
FIG. 8 shows a side view of one embodiment of the present invention.

In order to fit radio microphone M and police body worn camera R, the panels and portions need to be arranged at certain angles as shown in FIG. 8. Back panel 112 is parallel to back panel central axis 132. Rounded top portion 116 is parallel to rounded top portion central axis 136. First incline portion 120 is parallel to first incline portion central axis 140. First front panel 124 is parallel to first front panel central axis 144. Second incline portion 128 is parallel to second incline portion central axis 148. Second front panel 130 is parallel to second front panel central axis 150.

First angle θ1 is measured from back panel central axis 132 to rounded top portion central axis 136. Second angle θ2 is measured from rounded top portion central axis 136 to first incline portion central axis 140. Third angle θ3 is measured from first incline portion central axis 140 to first front panel central axis 144. Fourth angle θ4 is measured from first front panel central axis 144 to second incline portion central axis 148. Fifth angle θ5 is measured from second incline portion central axis 148 to second front panel central axis 150.

First angle θ1 should be acute and preferably about 65 degrees. Second angle θ2 and third angle θ3 should be approximately equal, obtuse, and about 130 degrees. The sum of first angle θ1, second angle θ2 and third angle θ3 should be less than 360 degrees. The first end of first front panel 124 which is proximate fourth angle θ4 should more proximate back panel 112 than the second end of first front panel 124 which is proximate third angle θ3. Fourth angle θ4 and fifth angle θ5 should be approximately equal. That is first front panel central axis 144 is parallel to second front panel central axis 150.

As used in this application, the term "a" or "an" means "at least one" or "one or more."

As used in this application, the term "about" or "approximately" refers to a range of values within plus or minus 10% of the specified number.

As used in this application, the term "substantially" means that the actual value is within about 10% of the actual desired value, particularly within about 5% of the actual desired value and especially within about 1% of the actual desired value of any variable, element or limit set forth herein.

All references throughout this application, for example patent documents including issued or granted patents or equivalents, patent application publications, and non-patent literature documents or other source material, are hereby incorporated by reference herein in their entireties, as though individually incorporated by reference, to the extent each reference is at least partially not inconsistent with the disclosure in the present application (for example, a reference that is partially inconsistent is incorporated by reference except for the partially inconsistent portion of the reference).

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

Any element in a claim that does not explicitly state "means for" performing a specified function, or "step for" performing a specified function, is not to be interpreted as a "means" or "step" clause as specified in 35 U.S.C. §112, ¶6. In particular, any use of "step of" in the claims is not intended to invoke the provision of 35 U.S.C. §112, ¶6.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A microphone and body worn camera holder, configured to join a police and security portable radio microphone and a police worn body camera to a shirt; the microphone holder comprising:

a back panel connected to rounded top portion; wherein the rounded top portion further comprises a first microphone attachment section;

a first incline portion, smoothly connected to the rounded top portion;

a first front panel, smoothly connected to the first incline portion; wherein the first front panel further comprises a body worn camera attachment section;

a second incline portion, smoothly connected to the first front panel; wherein the first front panel and the second incline portion further comprise a police worn body camera attachment portion;

a second front panel, smoothly connected to the second incline portion.

2. The microphone and body worn camera holder of claim 1, further comprising a high friction surface connected to the back panel.

3. The microphone and body worn camera holder of claim 1, further comprising:

a back panel central axis parallel to the back panel;

a rounded top portion central axis parallel to the rounded top portion; and a first angle, measured from the back panel central axis to the rounded top portion central axis; wherein the first angle is acute.

4. The microphone and body worn camera holder of claim 3, wherein the first angle is about 65 degrees.

5. The microphone and body worn camera holder of claim 3, further comprising:

a first incline portion central axis parallel to the first incline portion;

a second angle, measured from the rounded top portion central axis to the first incline portion central axis;

a first front panel central axis parallel to the first front panel; and a third angle, measured from the first incline portion central axis to the first front panel central axis.

6. The microphone and body worn camera holder of claim 5, wherein the second angle and the third angle are approximately equal.

7. The microphone and body worn camera holder of claim 5, wherein the second angle and the third angle are obtuse.

8. The microphone and body worn camera holder of claim 5, wherein the second angle and the third angle are about 130 degrees.

9. The microphone and body worn camera holder of claim 5, wherein a sum of the first angle, the second angle and the third angle is less than 360 degrees.

10. The microphone and body worn camera holder of claim 5, further comprising:

a second incline portion central axis parallel to the second incline portion;

a fourth angle, is measured from the first front panel central axis to the second incline portion central axis;

wherein a first end of the first front panel, which is proximate the fourth angle, is more proximate the back panel than a second end of the first front panel, which is proximate the third angle.

11. The microphone and body worn camera holder of claim 10, further comprising:

a second front panel central axis parallel to the second front panel a fifth angle, measured from the second incline portion central axis to the second front panel central axis;

wherein the fourth angle and the fifth angle are approximately equal;

wherein the first front panel central axis is parallel to the second front panel central axis.

* * * * *